US008351803B2

(12) United States Patent
Yamazaki

(10) Patent No.: US 8,351,803 B2
(45) Date of Patent: Jan. 8, 2013

(54) IMAGE FORMING APPARATUS

(75) Inventor: Masataka Yamazaki, Kuwana (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 198 days.

(21) Appl. No.: 12/827,198

(22) Filed: Jun. 30, 2010

(65) Prior Publication Data

US 2011/0002700 A1 Jan. 6, 2011

(30) Foreign Application Priority Data

Jul. 2, 2009 (JP) ..... 2009-157729

(51) Int. Cl.
*G03G 15/00* (2006.01)

(52) U.S. Cl. ..... 399/19

(58) Field of Classification Search ..... 399/19, 399/45, 49

See application file for complete search history.

(56) References Cited

U.S. PATENT DOCUMENTS

| | | | | |
|---|---|---|---|---|
| 6,243,545 | B1 * | 6/2001 | Jewell | 399/67 |
| 6,941,083 | B1 * | 9/2005 | Muratani | 399/49 |
| 2006/0171001 | A1 | 8/2006 | Kitagawa et al. | |
| 2006/0227202 | A1 | 10/2006 | Suzuki et al. | |
| 2008/0231875 | A1 | 9/2008 | Ohmiya | |

FOREIGN PATENT DOCUMENTS

| | | |
|---|---|---|
| JP | 9-248942 | 9/1997 |
| JP | 11-133679 | 5/1999 |
| JP | 11-160919 | 6/1999 |
| JP | 11-284818 | 10/1999 |
| JP | 2006-212894 | 8/2006 |
| JP | 2006-215251 | 8/2006 |
| JP | 2006-227460 | 8/2006 |
| JP | 2006-292824 | 10/2006 |
| JP | 2007-25205 | 2/2007 |
| JP | 2008-102201 | 5/2008 |
| JP | 2008-233370 | 10/2008 |

OTHER PUBLICATIONS

Japanese Official Action dated Apr. 19, 2011 together with an English language translation from JP 2009-157729.

Notification of Reasons for Refusal dated Jan. 17, 2012 received from the Japanese Patent Office from related Japanese Application No. 2009-157729, together with an English-language translation.

* cited by examiner

*Primary Examiner* — Walter L Lindsay, Jr.
*Assistant Examiner* — Frederick Wenderoth
(74) *Attorney, Agent, or Firm* — Scully, Scott, Murphy & Presser, PC

(57) ABSTRACT

An image forming apparatus is provided. The image forming apparatus includes: a printing section configured to perform duplex printing including printing N sheet on a first side thereof and subsequently printing M sheet on a second side thereof, wherein M is equal to or smaller than N, a suspension section which is configured to suspend the duplex printing in response to receiving a request for image adjustment during the duplex printing, while the sheet having the first face thereof printed is caused to stay in the image forming apparatus during the suspension, a correction section which is configured to update a correction data for image adjustment while the duplex printing is suspended by the suspension section, and a restarting section which is configured to restart the duplex printing suspended by the suspension section after the correction data has been updated by the correction section.

7 Claims, 5 Drawing Sheets

IMAGE FORMING APPARATUS

CROSS-REFERENCE TO RELATED APPLICATIONS

This application claims priority from Japanese Patent Application No. 2009-157729 filed on Jul. 2, 2009, the entire contents of which are incorporated herein by reference.

TECHNICAL FIELD

Aspects of the present invention relate to an image forming apparatus capable of duplex printing, and more particularly, to an image forming apparatus capable of duplex printing by printing a plurality of sheets on first sides thereof and subsequently printing the sheets on second sides thereof.

BACKGROUND

There has been proposed a technique (referred to as "a high-speed duplex printing") for improving a speed of the duplex printing process by printing N sheets (N is a positive integer) on the first side thereof and subsequently printing M sheets (M is an integer equal to or more than 0) on the second sides thereof. For example, for performing duplex printing on 10 pages (5 sheets), an image forming apparatus prints them in the page order of 2 (even page), 4 (even page), 1 (odd page), 6 (even page), 3 (odd page), 8 (even page), 5 (odd page), 10 (even page), and 7 (odd page), and 9 (odd page). Furthermore, an image forming apparatus prints them in the page order of 1, 3, 5, 2, 7, 4, 9, 6, 8, and 10.

However, the above-described duplex printing technique has the following problems. Specifically, high-speed duplex printing during which the sheets are caused to stay in the apparatus as mentioned previously can be improved in terms of an operating mode achieved when a request for image quality adjustment is received during the duplex printing.

For example, in relation to image adjustment on positional displacement or density deviation, correction process includes forming a test image on an image carrier, measuring the inspection image, and determining new correction data in accordance with a result of measurement. A conceivable operating mode employed during such correction process is to output sheets staying in the apparatus when the request for image adjustment is received and to perform correction process while printing is suspended. However, the operating mode entails temporary suspension of conveyance of a sheet during high-speed duplex printing, which in turn involves consumption of a time for outputting sheets in a conveying path and time for feeding a new sheet. Meanwhile, an operating mode disregarding correction process causes degradation of image quality.

SUMMARY

Accordingly, it is an aspect of the present invention to provide an image forming apparatus enhanced in operation when a correction request is received during duplex printing.

According to an illustrative embodiment of the present invention, there is provided an image forming apparatus comprising: a printing section configured to perform duplex printing including printing N sheet on a first side thereof and subsequently printing M sheet on a second side thereof, wherein M is equal to or smaller than N; a suspension section which is configured to suspend the duplex printing in response to receiving a request for image adjustment during the duplex printing, while the sheet having the first face thereof printed is caused to stay in the image forming apparatus during the suspension; a correction section which is configured to update a correction data for image adjustment while the duplex printing is suspended by the suspension section; and a restarting section which is configured to restart the duplex printing suspended by the suspension section after the correction data has been updated by the correction section.

DETAILED DESCRIPTION

Hereinafter, an image forming apparatus according to illustrative embodiments of the present invention will be described in detail by reference to the accompanying drawings. In the illustrative embodiments, there will be described an electrophotographic color printer as an example of the image forming apparatus. The color printer is capable of duplex printing by printing a plurality of sheets on the first sides thereof and subsequently printing the sheet on the second side thereof.

[Overall Configuration of Printer]

Figure 1:
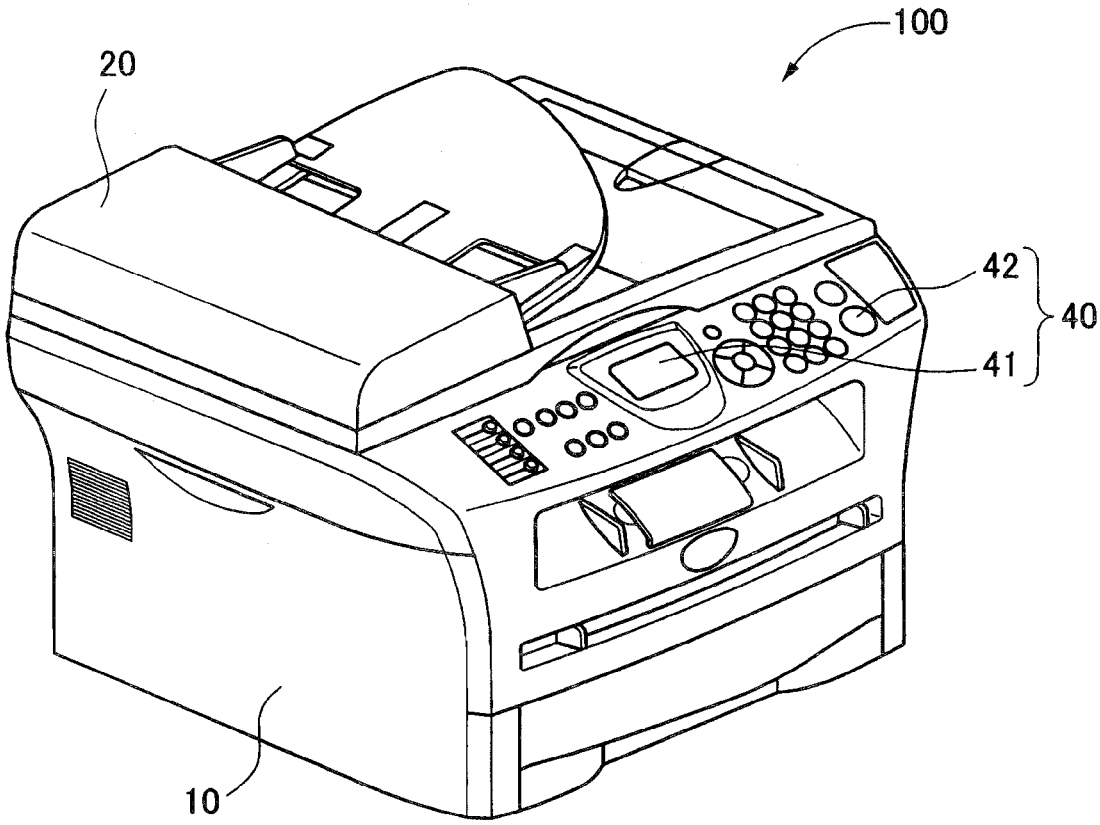
FIG. 1 is a perspective view illustrating a schematic configuration of a printer according to an illustrative embodiment.

As shown in FIG. 1, a printer 100 according to an illustrative embodiment includes an image forming section 10 (example of printing section) that forms an image on a sheet and an image reading section 20 that reads an image of an original document. On a front side of the image reading section 20, there is provided an operation panel 40 including a display section 41 that is configured as a liquid-crystal display, and a button group 42 including a start key, a stop key, numeric key pad, and the like. The operation panel 40 is configured to display an operating status of the printer and allow a user to perform an input operation.

[Configuration of Image Forming Section of Printer]

Figure 2:
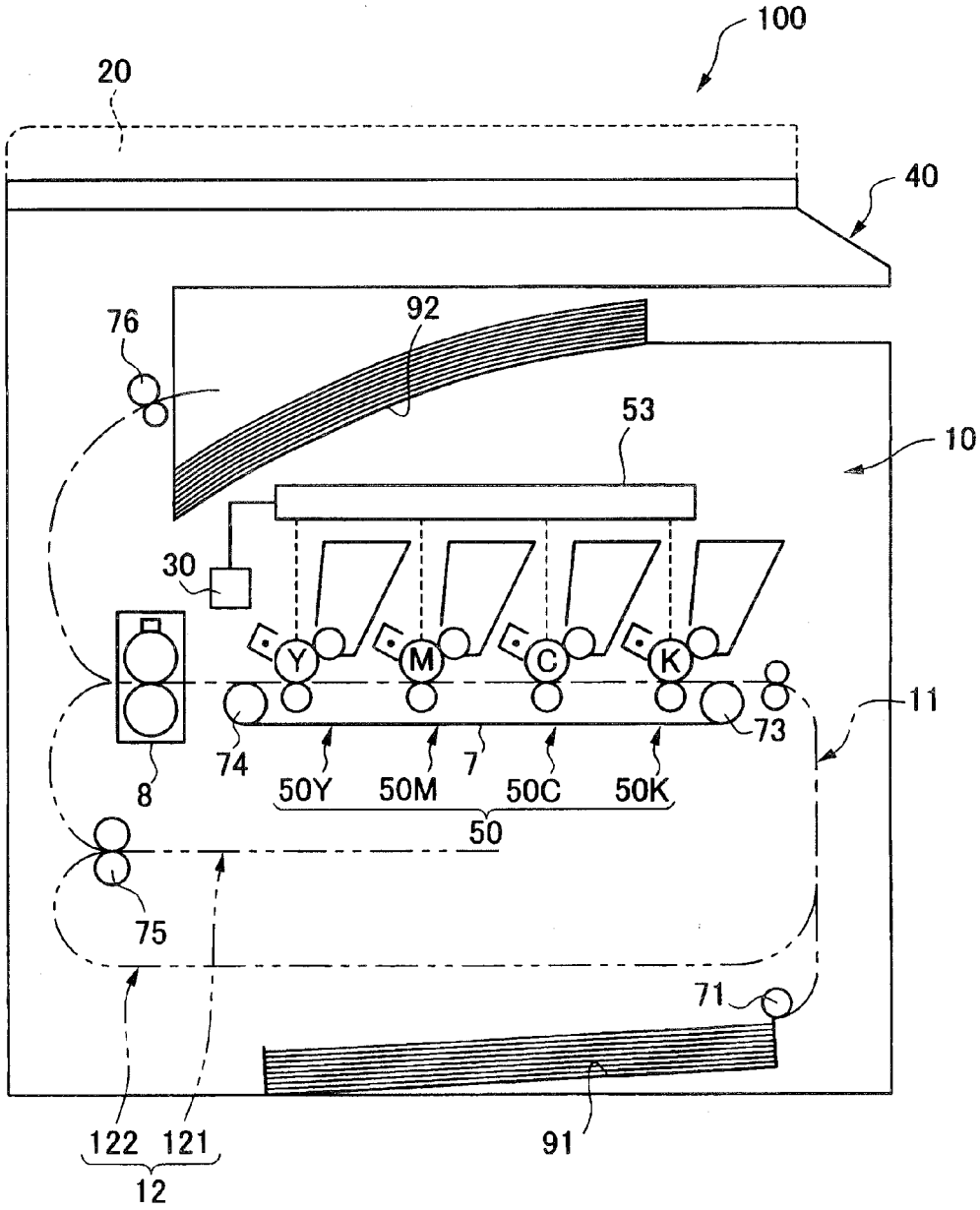
FIG. 2 is a conceptual diagram illustrating an internal configuration of an image forming section of the printer shown in FIG. 1.

As shown in FIG. 2, the image forming section 10 includes a processing section 50 that forms a toner image and transfers the toner image on a sheet, a fixing unit 8 that fixes unfixed toner on the sheet, a sheet feeding cassette 91 that accommodates sheets on which an image has not been formed yet, and a sheet discharging tray 92 that receives sheets on which an image has been formed. Along the conveying path 11, a sheet accommodated in the sheet feeding cassette 91 which is located on the bottom portion of the image forming section 10 is passed through a sheet feeding roller 71, the processing section 50, and the fixing unit 8, and is discharged by a sheet discharging roller 76 to the sheet discharging tray 92 which is located on the upper portion of the image forming section 10.

The processing section 50 is capable of forming a color image, and includes four processing units corresponding to the respective colors of yellow (Y), magenta (M), cyan (C), and black (K) which are arranged in parallel. Specifically, the processing section 50 includes a processing unit 50Y that forms a yellow (Y) image, a processing unit 50M that forms a magenta (M) image, a processing unit 50C that forms a cyan (C) image, and a processing unit 50K that forms a black (K) image. The processing section 50 further includes an exposure unit 53 that illuminates light on the respective processing units 50Y, 50M, 50C, and 50K, and a conveying belt 7 that is looped between rollers 73 and 74 and that conveys a sheet to transfer positions on the respective processing units 50Y, 50M, 50C, and 50K. Each of the processing units 50K, 50Y, 50M, and 50C is configure to form a toner image by an electrophotographic method.

The image forming section 10 feeds the sheets accommodated on the sheet feeding cassette 91 one by one, conveys the fed sheet to the processing section 50, and transfers the toner images formed by the processing section 50 onto the sheet. Furthermore, the sheet on which the toner images are transferred is conveyed into the fixing unit 8, and the toner images are thermally fixed on the sheet. Then, the fixed sheets are discharged to the sheet discharging tray 92.

Furthermore, the image forming section 10 has a duplex printing mechanism that prints both sides (first side and second side) of a sheet. As shown in FIG. 2, a conveying path 12 (a chain double-dashed line in FIG. 2) is used for reversing the sheet and conveying the sheet again to the processing section 50 so as to perform printing on the back side (the second side) of the sheet printed on one side (the first side). The conveying path 12 branches from the conveying path 11 at a position at a downstream side from the fixing unit 8 in a sheet conveying direction. The conveying path 12 includes a conveying path 121 (hereinafter referred to as a "temporary staying path 121") for allowing the sheet to stay in order to reverse the sheet conveying direction and a conveying path 122 (hereinafter referred to as a "returning path 122") for returning the reversed sheet to the conveyance path 11.

Specifically, in the duplex printing performed by the image forming section 10, the sheet is reversed in the following procedure. First, the sheet which is passed through the conveying path 11 (hereinafter referred to as a "forward conveying path 11") and has an image formed on the first side thereof, is thermally fixed by the fixing unit 8, and is subsequently sent to the conveying path 12 (hereinafter referred to as an "reverse conveying path 12"). Then, the sheet is conveyed into the temporary stop path 121, and the conveyance of the sheet is temporarily suspended. Thereafter, by turning the direction of the turning roller 75, the sheet conveying direction is reversed, and the sheet is conveyed to the returning path 122. Then, the sheet is returned to the forward conveying path 11 at an upstream side from the processing section 50. Accordingly, the sheet is reversed, and an image is formed on the second side.

The image forming section 10 has a function of successively printing N sheets (N is a positive integer) on the first sides thereof and subsequently printing M sheets (M is an integer equal to or more than 0 and equal to or less than N) on the second sides thereof at the time of performing the duplex printing. For example, when the number of sheets N to be successively printed is 3, and in a case of a finite loop type that repeats conveyance while fulfilling a relationship that N is equal to m M from the beginning of duplex printing, sheets are conveyed in the following procedure. First, the first sheet S1 is conveyed into the forward conveying path 11, and is printed on the first side thereof. Next, while the sheet S1 is conveyed into the temporary staying path 121, the second sheet S2 is conveyed into the forward conveying path 11, and is printed on the first side thereof. Subsequently, the sheet S1 is conveyed into the returning path 122, the sheet S2 is conveyed into the temporary staying path 121, and the third sheet S3 is conveyed into the forward conveying path 11. Then, the sheet S3 is printed on the first side thereof. In this state, the sheet S1 is caused to stay in the reverse conveying path 12 (being conveyed in the reverse conveying path 12), and is not returned to the forward conveying path 11. That is, two sheets are staying in the reverse conveying path 12. Thereafter, in order of the sheets S1, S2, and S3, the sheets are returned to the forward conveying path 11, and are printed on the second sides thereof. Consequently, the printing is performed in order of the first side of the first sheet, the first side of the second sheet, the first side of the third sheet, the second side of the first sheet, the second side of the second sheet, and the second side of the third sheet. This conveying order allows the standby time of the processing section 50 to be shorter as compared with the case where the printing is performed on a sheet in order of the first side and second side on a sheet-by-sheet basis, so that printing efficiency can be improved.

It is noted that the maximum number of sheets N to be successively printed is different depending on the number of sheets capable of staying in the reverse conveying path 12. The number of sheets capable of staying in the reverse conveying path 12 depends on the length of the reverse conveying path 12, the length of the sheet in the sheet conveying direction, etc. That is, the number of sheets N to be successively printed is not limited to 3 described above, but may be 2, or 4 or more.

[Electrical Configuration of Printer]

Figure 3:
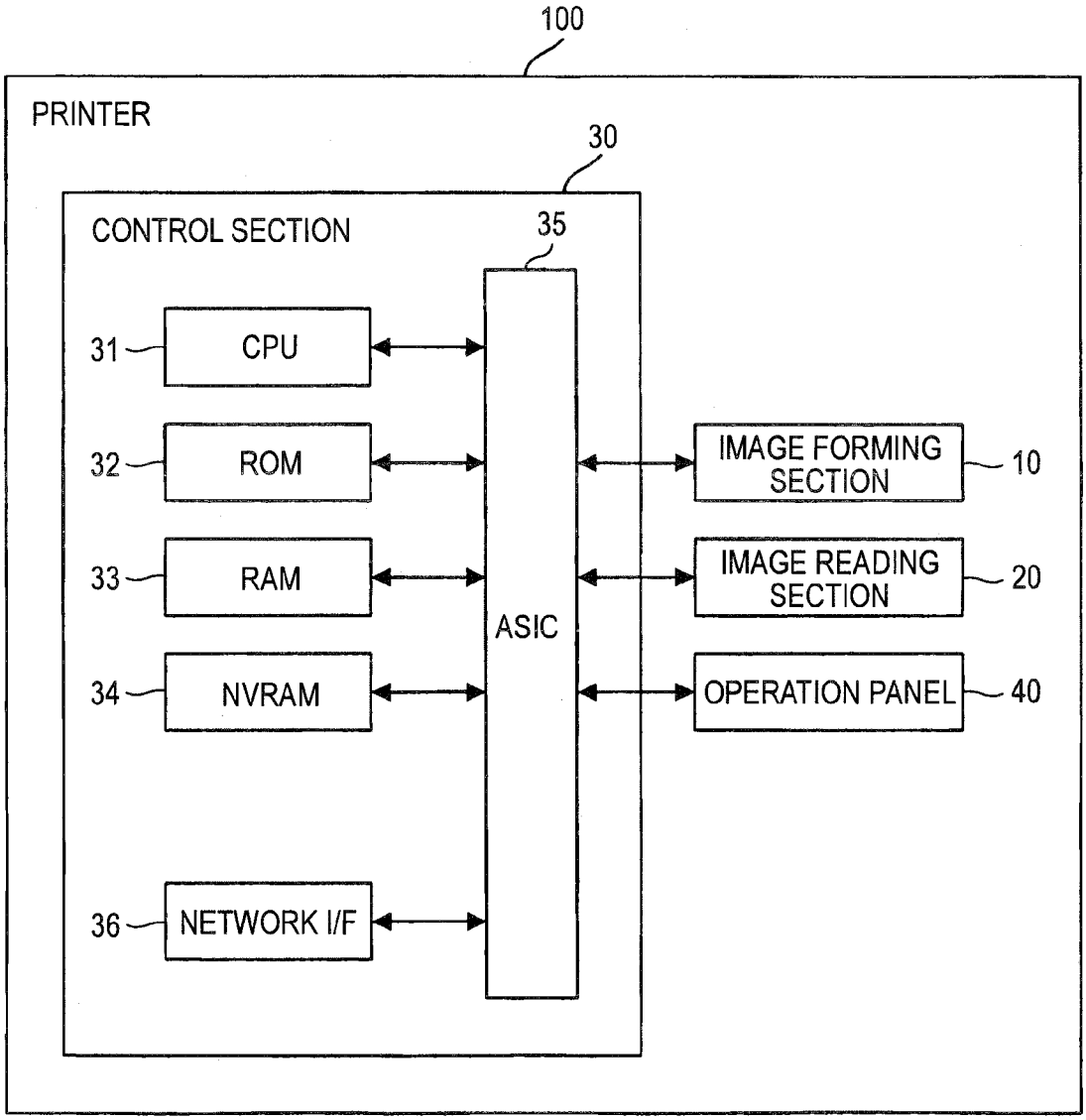
FIG. 3 is a block diagram illustrating an electrical configuration of the printer.

Subsequently, an electrical configuration of the printer 100 will be described. As shown in FIG. 3, the printer 100 includes a control section 30. The control section includes a Central Processing Unit (CPU) 31, a Read Only Memory (ROM) 32, a Random Access Memory (RAM) 33, a nonvolatile RAM (NVRAM) 34, an Application Specific Integrated Circuit (ASIC) 35, and a network interface 36. Furthermore, the control section 30 is electrically connected to the image forming section 10, the image reading section 20, the operation panel 40, etc.

The ROM 32 stores various control programs, and various settings for controlling the printer 100, initial values, etc. The RAM 33 is used as a work area, for which the various control programs are read, or as a storage area which temporarily stores image data.

The CPU 31 stores the processing result in the RAM 33 or the NVRAM 34 according to signals transmitted from various sensors and the control program read from the ROM 32, and controls various elements of the printer 100 through the ASIC 35 (for example, lighting timing of the exposure device 53, drive motors (not shown) of the various rollers constituting the forward conveying path 11 and the reverse conveying path 12, and moving motors (not shown) of an image sensor unit constituting the image reading section 20).

The network interface 36 is connected to a network such as the Internet to enable a communication with an external device 200 in which a printer driver for the printer 100 installed. The printer 100 is capable of communicating a print job through the network interface 36.

Duplex Printing Process

First Illustrative Embodiment

Figure 4:
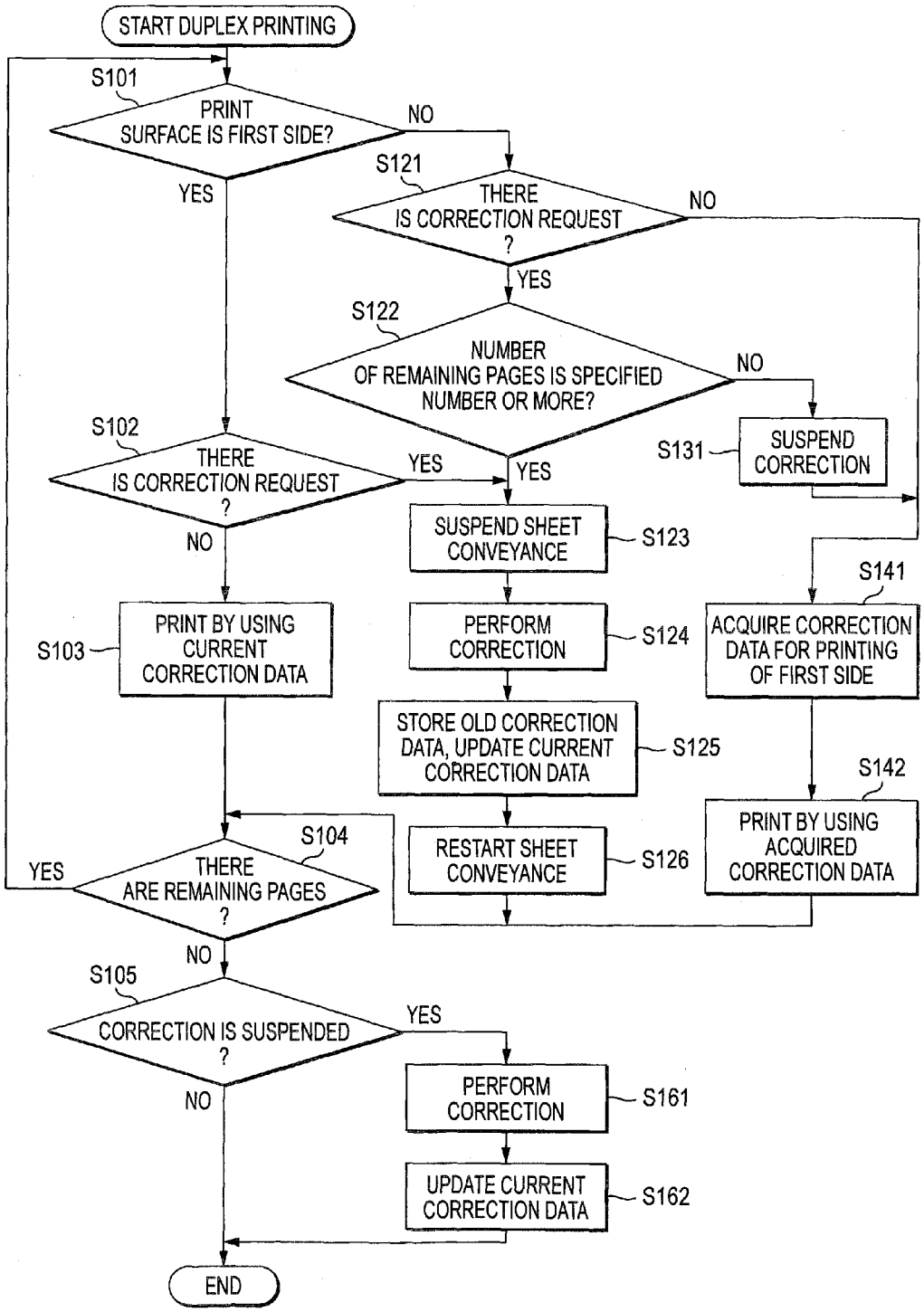
FIG. 4 is a flowchart illustrating a procedure of duplex printing process according to a first illustrative embodiment.

Hereafter, duplex printing process of the printer 100 according to a first illustrative embodiment of the present invention will be described with reference to the flowchart of FIG. 4. The printer 100 performs duplex printing process in response to, for example, a print job of duplex printing sent from the external device 200 or a command for duplex printing issued by way of the operation section 40.

First, it is checked whether a print surface is the first side (the side to be printed first) or the second side (the side to be printed later), and it is determined whether the print surface is the first side (S101).

When the print surface is the first side (YES in S101), it is determined whether a correction request pertaining to image adjustment on a positional displacement or a density deviation is received (S102). The printer 100 issues a correction request pertaining to image adjustment at predetermined timing (e.g., hourly timing such as every 24 hours, print count timing such as every 1000 sheets, and temperature timing such as timing at which an internal temperature of the printer is a threshold value or more). When a correction request is received (YES in S102), process proceeds to S123, where correction operation is performed by suspending conveyance of the next sheet. Details of correction operation pertaining to S123 and subsequent steps will be described later.

When no correction request is received (NO in S102), one side is printed by using current correction data (S103). The printer 100 stores correction data for image adjustment. The correction data are updated every time correction process pertaining to S124 to be described later is performed. Correction data updated when correction operation was lastly performed are stored as current correction data. The processing section 50 forms an image by reflecting current correction data.

Meanwhile, when the print surface is the second side (NO in S101) as in the case of the first side, it is determined whether a correction request is received (S121). When there is a correction request (YES in S121), the number of remaining pages of the print job being processed is checked, and it is determined whether the number of remaining pages is a specified number or more (S122).

When the number of remaining pages is small, that is, when printing of all of the pages is almost completed, influence inflicted on image quality will be small even if the high-speed duplex printing is not stopped and the correction data is not updated. It is preferred to give priority to high-speed duplex printing and perform correction process after completion of printing of all pages. Accordingly, the number of remaining pages which influence image quality is stored in advance as a specified number of pages. When the number of remaining pages is smaller than the specified number of pages (NO in S122), correction is suspended (S131). Specifically, a flag for storing the fact that correction is suspended is turned on in S131. Subsequent to S131, process proceeds to S141, where the remaining pages are printed.

When the number of remaining pages is equal to or greater than the specified number of pages (YES in S122), the correction operation pertaining to S123 and subsequent steps are performed. A sheet having the first side thereof printed and having the second side thereof not printed yet is first conveyed, as the correction operation, to the inversion conveying path 12. Duplex printing is suspended while the sheet is held in the printer 100 (S123). Correction process is performed after suspension of duplex print process (S124).

For example, the following operation is performed as the correction process. First, the respective processing units 50K, 50Y, 50M, and 50C form predetermined mark images, and the mark images are transferred on the conveying belt 7. Subsequently, the mark images transferred on the conveying belt 7 are read by a sensor arranged above the conveying belt 7, to measure an amount of displacement from a specified position. Correction data used for correcting the positional displacements are computed from the amount of displacement. Any correction process is applicable, as long as correction process pertains to image adjustment, such as positional displacements or density deviations. Correction process is not limited to the foregoing procedures.

After the correction process, correction data acquired through correction process are stored in a nonvolatile memory area (S125). Specifically, the correction data acquired before suspension are saved as old correction data in S125. Meanwhile, correction data acquired through correction process performed this time are updated as current correction data. The printer 100 stores at least two sets of correction data, that is, the current correction data that are updated correction data and the old correction data that are preceding correction data. After saving correction data, conveyance of the sheet is restarted (S126).

When there is no correction request (NO in S121) or when correction is suspended in S131, correction data used at the time of printing of the first side of a sheet whose second side is to be printed are acquired (S141). The second side is printed by use of the thus-acquired correction data (S142).

Specifically, when correction process has been performed after the printing of the first side, the current correction data may be already updated and the current correction data may differ from the correction data used during printing of the first side. Accordingly, in such cases, old correction data are acquired, and printing is performed by using the old correction data. The correction data used for the first side and the correction data used for the second side are thereby made equal to each other, and occurrence of a considerable difference between the first side and the second side in image quality, such as a hue, is expected to be avoided. Meanwhile, when correction process is not performed after printing of the first side, the current correction data are identical with the correction data used during printing of the first side. Therefore, the current correction data are acquired, and printing is carried out by using the acquired current correction data.

After printing of one side performed in connection with S103, printing of the other side performed in connection with S142, or restart of conveyance of a sheet performed in connection with S126, it is determined whether a remaining page (S104) exists. When a remaining page exists, that is, an unprinted page (YES in S104), process returns to S101, where printing of the remaining page is performed.

Meanwhile, when no remaining page exists (NO in S104), it is determined whether correction is suspended in S131 (S105). When correction is suspended (YES in S105), correction process is performed (S161), and correction data acquired through correction process are saved (S162). Specifically, the current correction data are updated. After correction pertaining to S162 or when correction is not suspended (NO in S105), process ends.

Second Illustrative Embodiment

Figure 5:
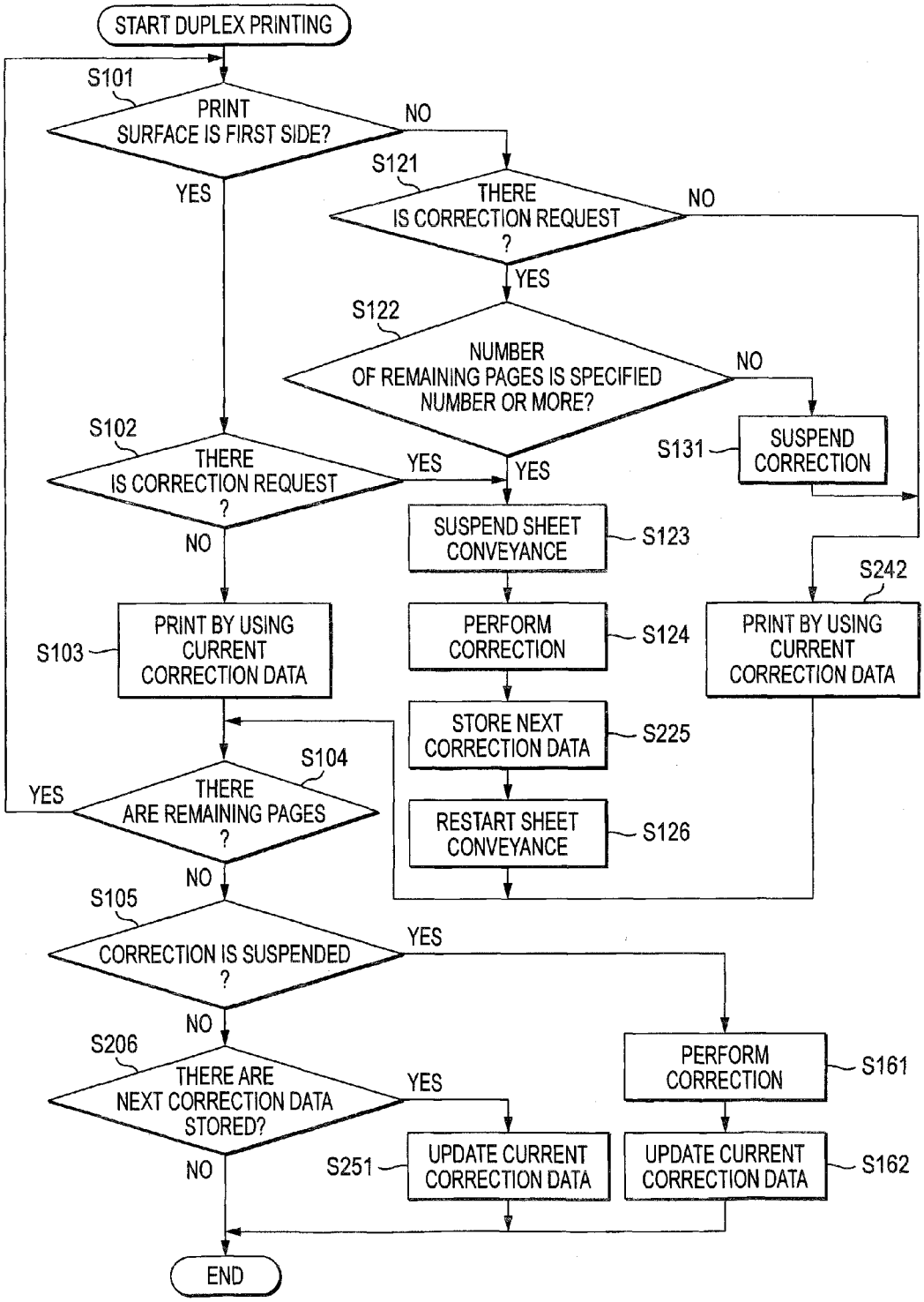
FIG. 5 is a flowchart showing a procedure of duplex printing process according to a second illustrative embodiment.

Hereafter, duplex printing process of the printer 100 according to a second illustrative embodiment of the present invention will be described with reference to the flowchart of FIG. 5. During the duplex printing process of the second illustrative embodiment, correction data used on a per-print-job basis are determined. In this regard, the present embodiment differs from the first illustrative embodiment in which correction data to be used are determined on a per-sheet basis. In FIG. 5, process analogous to that described in connection with the first illustrative embodiment is assigned the same step numbers as those shown in FIG. 4.

At first, it is determined whether a print surface to be printed next corresponds to the first side (S101). When the print surface corresponds to the first side (YES in S101), it is determined whether a correction request is received (S102). When there is a correction request (YES in S102), process proceeds to S123, where correction operation is performed. When there is no correction request (NO in S102), the first side is printed by using current correction data (S103).

Meanwhile, when the print surface corresponds to the second side (NO in S101), it is determined, as in the case of the first side, whether a correction request is received (S121). When there is a correction request (YES in S121), it is determined whether the number of remaining pages is a specified number or more (S122). When the number of remaining pages is smaller than the specified number of pages (NO in S122), a correction is suspended (S131). Subsequent to S131, process proceeds to S242, where the remaining pages are printed.

When the number of remaining pages is equal to or greater than the specified number of pages (YES in S122), a sheet having the first side thereof finished printing and having the second side not yet printed is caused to stay in the printer 100, and the duplex printing is suspended (S123). Correction process is performed after suspension of the duplex printing process (S124).

After performing the correction process, correction data acquired through the correction process are saved (S225). Specifically, correction data acquired through the correction process are saved as next correction data. Current correction data are not updated and stored as they are. Specifically, the printer 100 stores at least two sets of correction data; that is, the current correction data stored at the beginning of a print job and the next correction data acquired through the correction process. After storage of the correction data, conveyance of the sheet is restarted (S126).

When there is no correction request (NO in S121) or when correction is suspended in S131, the second side is printed by using the current correction data (S242). Specifically, in the present embodiment, the next correction data are not used even after the correction, and printing is performed by using the current correction data. The correction data used for the first side and the correction data used for the second side are thereby made equal to each other, and occurrence of a considerable difference between the first side and the second side in image quality, such as a hue, is expected to be avoided.

After printing of the first side performed in connection with S103, printing of the second side performed in connection with S242, or restart of conveyance of a sheet performed in connection with S126, whether it is determined a remaining page exists (S104). When there is a remaining page, that is, an unprinted page (YES in S104), process returns to S101, where the remaining page is printed.

Meanwhile, when there is no remaining page (NO in S104), it is determined whether correction is suspended in S131 (S105). When correction is suspended (YES in S105), correction process is performed (S161), and a correction result is saved (S162). Specifically, correction data acquired through correction process are updated as current correction data. Meanwhile, when correction is not suspended (NO in S105), it is determined whether the next correction data are stored (S206). When the next correction data are stored (YES in S206), the stored next correction data are updated as current correction data (S251). After the update process, the stored next correction data are deleted. After updating of the current correction data in connection with S162 or S251 or when there are no next correction data (NO in S206), process ends.

As already described in detail, the printer 100 of the present embodiment can perform duplex printing including a process of printing M (M≦N) second sides after having printed N first sides. During duplex printing, a value of two or more is selected as a value of N at least once. When there is a request for image adjustment during high-speed duplex printing, the printer 100 suspends the duplex printing without outputting the sheet having its first side printed while holding the sheet in the inversion conveying path 12 and performs correction process for image adjustment. The duplex printing is restarted after the correction process while the sheet is still held in the conveying path. Specifically, in performing the correction process, the printer 100 maintains conveyance of a sheet without suspension. A time used only for outputting a sheet in the printer or a time used only for conveying a new sheet do not arise. For these reasons, when compared with an operating mode in which all sheets having their first sides printed are output simultaneously with receipt of a request for image adjustment, printing can be restarted earlier. Additionally, since image adjustment is effected even in the middle of the duplex printing, a possibility in degradation of image quality is small.

The present embodiments are merely illustrative and do not pose any limitation on the present invention. Therefore, it is natural that the present invention be susceptible to various improvements and modifications within the scope of the invention. For instance, the present invention is not limited to a printer and applicable to any apparatus, as long as the apparatus has an image forming function, such as a multifunctional machine and a facsimile. An image forming method of the image forming section is not limited to electrophotography and may also be an inkjet method. The apparatus may also be able to form a color image or specifically designed to form a monochromatic image.

In the example conveyance of the illustrated embodiments, a plurality of first sides is continually printed, and the second sides equal in number to the first sides are subsequently printed. However, after continual printing of the plurality of first sides, printing of the second side and printing of the first side may also be performed alternately. For example, in a case of an infinite loop type that takes a value of two for the number of continual prints N at the beginning of conveyance of a sheet and that takes a value of one for both N and M after initiation of conveyance of the sheet, a first sheet is output to the sheet output tray 92 after the second side of the first sheet has been printed. Thereafter, a third sheet S3 is conveyed into the forward conveying path 11, and the first side of the third sheet is printed (step A). At this time, a second sheet S2 is kept stayed in the inversion conveying path 12 and is not returned to the forward conveying path 11. Subsequently, the third sheet S3 is conveyed into the inversion conveying path 12, and the second sheet S2 is returned to the forward conveying path 11, and the second side of the second sheet is printed (step B). Process pertaining to the step A and process pertaining to the step B are then iterated. For example, provided that four sheets are subjected to duplex printing, the sheets are printed in sequence of the first side (a first sheet), the first side (a second sheet), the second side (the first sheet), the first side (a third sheet), the second side (the second sheet), the first side (a fourth sheet), the second side (the third sheet), and the second side (the fourth sheet). In the mode of conveyance of the infinite loop type, suspension, such as that arising in the conveyance mode of a finite loop type, does not arise. Therefore, the conveyance mode including temporary output of sheets in the printer during correction process is not appropriate, and the present invention is preferable.

The image forming section 10 may also have a function of switching the number of continual prints N and M. Switching N and M is implemented by timing for sheet conveyance and control of conveyance speed.

The present invention using old correction data is suitable for an image forming apparatus having a so-called manual duplex printing function, namely, a function of manually setting a bundle of output sheets whose first sides have continually been printed into a reading device again and continually subjecting the second sides of the sheets to printing.

The location where a sheet is caused to stay during correction process is not limited to a position in the inversion conveying path 12. Specifically, the essential requirement is that the location be a position where correction process is not affected (a position except a point on the conveying belt 7 in the embodiment), and the location may also be situated in the forward conveying path 11.

Conceivable timing for starting use of correction data after suspension is; for example, timing achieved after completion of duplex printing or re-activation of power, but an advantage of image adjustment can be yielded earlier by using new correction data for a new sheet or a new job.

In the case of sheet conveyance involving iteration of operation pertaining to the relationship that N is equal to M from the beginning (also called, as required, a finite loop type), a wait time of the process section consumed in a period between sheets becomes shorter as the value of N becomes greater, and an attempt to speed up of process can be expected. Meanwhile, as the value of N becomes greater, the number of sheets staying in the apparatus (i.e., the number of staying sheets) becomes greater, and the chance of a request for image adjustment being received while a large number of sheets staying in the apparatus becomes greater. For this reason, the printing section that enables using correction data achieved before suspension is suitable.

What is claimed is:

1. An image forming apparatus comprising:

a printing section configured to perform duplex printing including printing N sheet on a first side thereof and subsequently printing M sheet on a second side thereof, wherein M is equal to or smaller than N;

a suspension section which is configured to suspend the duplex printing in response to receiving a request for image adjustment during the duplex printing, while the sheet having the first side thereof printed is caused to stay in the image forming apparatus during the suspension;

a correction section which is configured to update a correction data for image adjustment while the duplex printing is suspended by the suspension section;

a restarting section which is configured to restart the duplex printing suspended by the suspension section after the correction data has been updated by the correction section; and a storage section which is configured to store a correction data acquired before the suspension of the duplex printing and to store the updated correction data, wherein the printing section prints the second side of the sheet which is caused to stay in the apparatus during suspension of the duplex printing based on the correction data acquired before the suspension; and wherein the printing section is configured to print a sheet fed after the restart of the duplex printing or to print a job started after the restart of the duplex printing, based on the correction data updated by the correction section.

2. The image forming apparatus according to claim 1, wherein the printing section is configured to repeatedly feed a sheet while fulfilling a relationship that N is equal to M, from start of the duplex printing.

3. The image forming apparatus according to claim 1, wherein the duplex printing includes feeding sheets while fulfilling a relationship that N is larger than M.

4. The image forming apparatus according to claim 1, wherein, when a request for image adjustment is received while an unprinted data value is equal to or smaller than a threshold value, the correction section updates the correction data after printing of the unprinted data without suspending the duplex printing.

5. The image forming apparatus according to claim 1, wherein the correction section is configured to form a test image on an image carrier, measure the test image, and determine a correction data in accordance with a result of the measurement.

6. The image forming apparatus according to claim 1, wherein the printing section prints the second side of the sheet based on the same correction data used to print the first side of the sheet.

7. The image forming apparatus according to claim 1, wherein the printing section is configured to perform duplex printing of a print job comprising a plurality of sheets, the correction section updates the correction data after the printing section completes printing of the print job.

* * * * *